United States Patent [19]

Spiliotis et al.

[11] 4,082,621

[45] Apr. 4, 1978

[54] PLATING METHOD WITH LEAD OR TIN SUBLAYER

[75] Inventors: Nicholas J. Spiliotis, Parsippany, N.J.; William R. Schevey, Honesdale; Donald W. Himler, Easton, both of Pa.

[73] Assignee: Allied Chemical Corporation, Morris Township, N.J.

[21] Appl. No.: 756,158

[22] Filed: Jan. 3, 1977

[51] Int. Cl.[2] ..... C25D 5/12; C25D 5/56

[52] U.S. Cl. ..... 204/38 B; 204/38 E; 428/626; 428/645; 428/646; 428/648

[58] Field of Search ..... 428/645, 646, 648, 626; 204/38 B, 38 E, 41

[56] References Cited

U.S. PATENT DOCUMENTS

| | | | |
|---|---|---|---|
| 1,738,748 | 12/1929 | Wirshing et al. | 204/38 B X |
| 3,009,238 | 11/1961 | Wesley et al. | 428/646 X |
| 3,471,271 | 10/1969 | Brown et al. | 204/41 X |
| 3,615,281 | 10/1971 | Ramsden | 428/626 X |
| 3,661,538 | 5/1972 | Brown et al. | 204/38 B X |
| 3,866,289 | 2/1975 | Brown et al. | 204/41 X |
| 3,868,229 | 2/1975 | Hurley | 428/626 X |
| 3,930,807 | 1/1976 | Kobayashi et al. | 204/38 B |

FOREIGN PATENT DOCUMENTS

| | | | |
|---|---|---|---|
| 700,535 | 12/1953 | United Kingdom | 204/41 |

*Primary Examiner*—G. L. Kaplan

*Attorney, Agent, or Firm*—Alan M. Doernberg; Jay P. Friedenson

[57] ABSTRACT

A nickel or cobalt layer is electroplated from a fluoborate bath directly onto a lead or lead alloy or tin or tin alloy sublayer, which has been electroplated onto a metal surface. Microcracked chrome is electroplated over the nickel or cobalt layer. With a nonconductive plastic substrate, the sublayer is electroplated onto a metal film which was deposited on the plastic by an electroless method. The plated product includes a sublayer of about 0.05 to 2 mils lead or lead alloy or tin or tin alloy, a second layer of about 0.05 to 2 mils nickel or cobalt, and an outer layer of about 0.001 to 1 mil chrome.

13 Claims, No Drawings

PLATING METHOD WITH LEAD OR TIN SUBLAYER

BACKGROUND OF THE INVENTION

The invention relates to plating methods and plated products. In particular, the invention relates to a multilayer plating method on a metal surface, and especially on a metal film on a plastic substrate, and most especially to a plastic substrate of ABS (acrylonitrile butadiene styrene) with an electroless metal coating.

As is well known in the art, such plating occurs by making the metal, or any conductive substance, the cathode in an electrolytic cell in which current is applied at the desired current density.

Plated plastic articles are known having an electroless metallic film such as copper on the plastic, an electrolytically deposited copper (usually bright copper from the cyanide or sulfate), bright nickel (from Watts nickel or the sulfate), followed by chromium, including microcracked chromium. Copper and nickel fluoborates, with suitable brighteners, have been used in electroplating baths in such a process. U.S. Pat. No. 3,748,236 discloses a brightener for such a system. Fluoborate plating systems are known to provide advantages in plating speed, ease of bath preparation from liquid concentrates, reduced pollution and easy process control.

Traditional copper-nickel-chromium systems have provided a satisfactory level of brightness, ranging from semi-bright to full bright. However, plated articles, and particularly plated plastic articles, with a copper sublayer often exhibit unsightly (green) corrosion products. Such plated plastic articles may not withstand temperature cycling including temperatures below 0° C.

Multi-layer plating systems on conductive substrates such as steel have been known including a wide variety of metals or alloys for each layer. For example, U.S. Pat. No. 2,428,318 discloses coated steel articles with at least three layers of at least two different metals, said to provide increased rust resistance with thinner layers. One product is coated with 0.0005 inch nickel, 0.001 inch lead and 0.0005 inch nickel.

U.S. Pat. No. 2,658,266 discloses a metal substrate coated with a nickel flash (from the sulfate and chloride), lead (from the fluoborate), bright (preferably buffed) antimony, a nickel flash and chromium. The stated purpose is to minimize the use of costly nickel and to form a brighter finish and greater corrosion resistance than with certain prior art multi-layers. This patent states that the lead layer may be omitted if the steel is first roughened. The antimony layer is not stated to be dispensable. In accordance with the stated purpose of conserving nickel, the thickness of the first nickel flash is preferably 0.01 to 0.1 mil (although up to 0.5 mil) and of the second flash 0.001 to 0.05 mil (preferably 0.002 to 0.03).

U.S. Pat. No. 2,714,088 discloses a steel article coated with lead, antimony, nickel and chromium.

U.S. Pat. No. 3,009,238 discloses a composite coating on steel including a plurality of electro deposited nickel layers and a layer of a dissimilar metal, including cobalt, tin or lead, between each nickel layer.

BRIEF DESCRIPTION OF THE INVENTION

The method of the invention includes electrolytically plating a sublayer onto a conductive metal surface of a substrate, with the sublayer including predominantly lead, tin or alloys of either or both. A nickel or cobalt layer is plated from a fluoborate bath directly onto the sublayer. Chromium, preferably microcracked, is plated onto the nickel or cobalt layer. In preferred embodiments, the sublayer is plated from an electrolytic bath containing at least 90% lead by weight of cation. In some embodiments, there are additives and trace metals present in the electrolytic baths. For example, hydroquinone is used as a smoothing agent in the lead bath. Also in preferred embodiments, the layer and sublayer are plated from fluoborate baths, using particularly the fluoborates of nickel or cobalt.

In some preferred embodiments, a non-conductive plastic such as ABS forms the substrate with an electroless metal plated on the substrate to form the metal surface. In some preferred embodiments, an electrolytic flash of a similar metal, such as a nickel flash on an electroless nickel layer, is then plated before electroplating a sublayer and layer.

The plated article of the invention includes a substrate, a sublayer of about 0.05 to about 2 mils lead or tin or alloys thereof, a second layer of about 0.05 to about 2 mils nickel or cobalt or alloys thereof directly on the sublayer, and an outer chromium layer.

The plated articles are especially resistant to temperature cycling and corrosion. Even if corrosion occurs, the unsightly green corrosion products of traditional copper-nickel-chromium systems are avoided. Additionally, if lead is used for the sublayer, substituted for the more expensive copper.

Detailed Description of the Invention

The electroplating method of the invention includes electrolytically plating on the metal surface of a substrate (1) a layer of lead, tin or alloys thereof, (2) a second layer of nickel, cobalt or alloys thereof directly onto the sublayer, and (3) an outer chromium layer.

Throughout this Specification, "predominantly" is used to mean at least about 50%. Where indicated, higher percentages are preferred. Similarly, "effective" concentrations of a metal cation in solution are used to indicate the weight amount of that metal that would immediately plate out from that solution onto a cathode at moderate current density and sufficient voltage to plate the specific cation, as a proportion of the total weight of metal that would plate on such a cathode.

Throughout the examples, the concentration of the "predominant" cation or cations should preferably remain above about 5 g/l in order to assure continued substantial plating rates. The "effective" metal cation proportion should remain above about 50% or the preferred higher percentage.

The substrate must be electrically conductive in order to electroplate the sublayer onto it. However, the invention includes in some preferred embodiments nonconductive substrates such as plastics which have been coated by an electroless process with a film or a conductive metal. In the specific examples that follow, a nickel film is used, but it should be understood that any metal which can be deposited from an electroless bath may be employed, with copper being another preferred example. The electroless bath employed are well known in the art and are not, by themselves, a novelty feature of the invention. In some embodiment of the invention, a metal flash or strike is electroplated on the film before electroplating the sublayer. By flash or strike is meant a thin layer formed by a quick electrolytic plating. Generally, such thin layers do not exceed 0.1 mils. Sufficient thickness is usually provided to form a continuous layer. The electroless films on plastic surfaces are similarly quite thin, under about 0.03 mils, but sufficiently thick to form a single continuous layer. In some preferred embodiments, the electrolytic strike is of the same metallic composition in the electroless layer, as for example, a nickel fluoborate strike onto an electroless nickel layer.

It should also be understood that many suitable plastic substrates are known, onto which an electroless metal layer may be deposited. Such plastics include polysulfones, polypropylenes, polystyrenes, epoxys, phenolics, acrylics and the like. Various methods have been developed in the art, as for example in U.S. Pat. No. 3,790,400, for preparing such plastic substrates for electroless plating. Neither the method of preparing the plastic for an electroless deposit, nor the bath or method of depositing electroless metal form novel parts of the present invention, with a wide variety of such substrates and methods being known in the art.

Similarly, electroplating on a variety of metal substrates is well known in the art, and does not, by itself, form a novel part of the present invention. The present invention is rather concerned with a novel arrangement of sublayer, second layer and outer layer on a wide variety of substrates. By metal is meant any conductive material including alloys. Iron and iron alloys are the materials most commonly coated with other materials, to protect against corrosion. However, any other metal which is itself conductive or can be coated with a conductive layer may be used. Preferred metals are those subject to high corrosion rates if not coated by such chromium and underlay systems as this invention is concerned with.

The sublayer of the present invention is predominantly lead or tin or mixtures thereof. For certain applications, lead is preferred because it is generally cheaper than tin and because plated products with a lead sublayer exhibit less cracking when subjected to temperature below 0° C. However, for many applications, a sublayer of up to 100% tin or up to 100% lead or any combination thereof would be suitable. For example, sublayers of lead and tin, from 0 to 100% tin and from 0 to 100% lead are suitable for particular articles. Similarly, either lead or tin may be alloyed with another metal or metals, or alloys of lead, tin and other metals may be used. In preferred embodiments, the sublayer includes at least about 50% lead, tin or both, and in most preferred embodiments, the sublayer includes at least 75% lead, tin or both. Exemplary sublayers include about 90 to 99% lead and about 1 to 10% antimony by weight. Other exemplary sublayers include 20 to 80% lead, 20 to 80% tin and 0 to 40% copper. A wide variety of other metals may be included in the sublayer, preferably in alloys having at least 50%, and most preferably at least 75% lead, tin or both. Exemplary other metals include iron, cadmium, zinc and indium.

It should be understood that the sublayer is electroplated from a bath containing salts of lead, tin or both, either alone or in combination with one or more other metal. It should be appreciated that for the desired alloy compositions to have preferably at least about 50% lead, tin or both, and most preferably at least about 75% lead, tin or both, the concentration of lead and tin ions, by weight of cation, would normally be within the desired weight percentages of the weight of cation in the solution. However, the bath may also include the cations of metals much less electronegative than lead or tin, such as for example alkali or alkali earth metals, which, although forming a part of the cations in solution, would not normally plate onto the surface. Accordingly, in describing the "effective" cation composition of the electrolytic baths, it should be appreciated that cations of metals much less electronegative than tin or lead may be disregarded, as not affecting the composition of the alloys actually plated onto the metal surface.

In preferred forms, the lead, tin or both are electroplated onto the metal surface of the substrate using, for example, the fluoborate baths of each or both metal. For example, baths consisting essentially of lead fluoborate and tin fluoborate may be used to electroplate the sublayer. Similarly, various amounts of antimony fluoborate or copper fluoborate, or other metals desired in an alloy sublayer, may be incorporated into the lead fluoborate or tin fluoborate baths.

Although the sublayer and other layers of the plated articles of the present invention need not normally be very bright, the present invention does contemplate various smoothening or brightening agents in the electrolytic baths. In particular, with lead baths, it has been found that hydroquinone, up to about 5% of the weight of the lead cation, is a suitable smoothening agent. However, other smoothening and brightening agents well known in the art may be incorporated into the various electrolytic baths.

The second layer, including predominantly nickel or cobalt or mixtures thereof, is, in the present invention, electrolytically deposited directly onto the sublayer. As with the sublayer, the composition of the second layer may vary from up to 100% nickel, up to 100% cobalt, or up to 100% nickel and cobalt. Preferred second layers include at least about 50% nickel or cobalt or both, and about 50% or less of other metals. In most preferred forms, the second layer includes at least about 90% nickel or cobalt, or both. Other materials in second layer can include lead, tin, antimony, copper, or a variety of other metals, such as iron, cadmium, indium and zinc. However, in many preferred forms, the second layer consists essentially of pure nickel, cobalt or alloys of nickel and cobalt only. The effective nickel or cobalt cation percentage corresponds to the desired nickel or cobalt percentage in the second layer.

Nickel or cobalt second layers may be electroplated from a variety of electrolytic baths onto the sublayer. However, in preferred forms where the sublayer is essentially all lead or tin or both, it has been found that nickel or cobalt fluoborate electrolytic baths are especially suitable. It appears that nickel or cobalt fluoborate baths produce an electrolytic nickel or cobalt layer on the lead that adheres particularly well. While the invention is not limited to a particular theory, it appears that many common nickel baths, as for example, Watts nickel or nickel sulfate, produce an insoluble lead salt at the interface between the sublayer and second layer. For example, a lead sulfate salt or a lead chloride salt between the lead sublayer and the nickel second layer causes poor adherence between the sublayer and second layer. Accordingly, while other nickel or cobalt baths besides the fluoborate would provide good adherence when no insoluble salt can be expected, the fluoborate baths are particularly suitable since they produce few known insoluble salts with the metals of either the sublayer or second layer.

An outer layer consisting essentially of chromium is deposited from an electrolytic bath, including for example, chromium oxide, onto the second layer. In many preferred forms, the resultant chromium layer is desirably microcracked, and for such preferred embodiments, a microcracking agent is added to the chromium oxide bath. A number of acids and salts such as fluosilicic acid and various proprietary compositions are known in the art to produce microcracked chrome layers and the fluosilicic acid agent used in the examples that follow, although a preferred microcracking agent, is not intended to limit the invention. Instead the chromium bath by itself, and methods for plating microcracked chromium, are known in the art, and any such microcracking agent may be used to produce such microcracked chrome layers. Also, a non-microcracked chromium layer may be deposited according to the present invention.

By stating that the method and product includes a substrate with a metal surface, a sublayer including lead or tin, a second layer including nickel or cobalt and an outer layer including chromium, it is not intended that the product not include other layers. For example, various other sublayers may be deposited before the lead or tin sublayer. Similarly, other electrolytic metals may be deposited above the nickel second layer. However, the present invention contemplates depositing the nickel or cobalt second layer directly onto the lead or tin sublayer, and in many preferred forms, the outer chromium layer is deposited directly onto the nickel or cobalt second layer.

The parameters of plating the various metals from electrolytic baths onto the substrate are individually known in the art. Proper control of metal concentration and proper control of pH and current densities and the like in order to produce the desired thicknesses of each layer, are well known. In the examples that follow, suitable current densities are given as illustrative, and it is not intended that any operative plating parameters be excluded from the present invention. It is rather the order of plating steps, and the resulting order of plated layers, that is a novel part of the present invention.

In preferred embodiments, the plated article includes a substrate with a metal or other conductive surface, a sublayer with from 0.01 to 3 mils and preferably from about 0.05 to about 2 mils thickness and including predominantly lead, tin or both, a second layer of from 0.01 to 3 mils and preferably about 0.05 to about 2 mils thickness predominantly nickel, cobalt or both and an outer layer of from about 0.00 to 2 mills and preferably about 0.05 to about 1 mil thickness of predominantly chromium. In some preferred forms, the outer chromium layer includes microcracked chromium. In many preferred forms, the substrate is a plastic such as ABS, and the plated article includes a thin film of a metal which can be deposited by an electroless bath on the plastic substrate. In some preferred forms, the thin film is covered by a thin electrolytic layer of a similar or different metal from the electroless layer, followed by the predominantly lead or tin sublayer.

EXAMPLE 1

Preparation of Plastic Substrate With Metal Film Surface

Standard plated plaques were coated with a thin nickel film according to the following procedure. The plaques were Acrylonitrile Butadiene Styrene plaques obtained from the Marbon Chemical Company, a division of Borg-Warner Chemical of Parkesburg, West Virginia.

The plaques were rinsed in a cleaner solution PM-900, obtained from the Shipley Company, of Newton, Massachusetts, for an immersion time of 3 minutes. It was made up as 1 Part Cleaner PM-900 in 80 Parts Water. Next the plaques were rinsed in 150° F water for 3 minutes followed by room temperature water for 3 minutes.

The plaques were then conditioned with Conditioner PM-940 obtained from the Shipley Company and made up by dissolving 360 grams of Chromic Acid ($Cr_2O_3$) in 600 ml water and adding 20 ml sulfuric acid and 100 ml Conditioner 940. The plaques were immersed in the Conditioner for 5 minutes at a solution temperature of 145° F using air agitation.

The plaques were then rinsed with deionized water three (3) times, first hot and twice cold. Next, the plaques were dipped in hydrochloric acid (one part HCl to 5 parts of water by volume) for 10 seconds at room temperature. No rinse in water followed.

A catalyst (Catalyst 9F of The Shipley Company) was made up from 5 parts deionized water and 2 parts HCl plus 1 part Catalyst 95 Concentrate (The Shipley Company). The plaques were immersed in this catalyst system at room temperature with moderate agitation, but not air, for anywhere from 2–10 minutes, generally 5 minutes. The plaques were then rinsed for 30–60 seconds each in two (2) deionized baths, with the second bath being a fast overflowing water system.

Next, the plaques were dipped in an accelerator solution containing 120 grams Accelerator F906 (from The Shipley Company) in 1 liter of water at 105° F for a time of 5 minutes (an equal time to the catalyst dip.) The plaques were then rinsed twice with deionized water.

A layer of electroless nickel was then applied using the Cuposit Electroless Nickel PM-980 (a trademark of the Shipley Company) bath. The solution was made up with 7 parts deionized water, 1 part PM-980 Concentrate (obtained from the Shipley Company) adjusted with ammonium hydroxide until the pH reached 8.5–9.5. The plaques were dipped for 10–12 minutes in the solution at 75° F to produce a nickel layer of 11–15 millionths of an inch or 0.011–0.015 mils. The plaques were then rinsed twice with deionized water.

Next the plaques were electroplated for 1 minute at a current density of 40 ASF with an aqueous solution of 400 g/l nickel fluoborate (a nickel equivalent of 110 g/l). The plaques were then rinsed with deionized water.

EXAMPLE 2

Preparation of Electrolytic Baths

Several electrolytic baths were prepared. The standard compositions and plating conditions are set forth below:

| | |
|---|---|
| 1. UBAC Copper (UBAC is a trademark of the Udylyte Company of Detroit Michigan | |
| Copper Sulfate ($CuSO_4 - 5H_2O$ | 210 g/l |
| Sulfuric Acid ($H_2SO_4$) | 52 g/l |
| UBAC No. 1 .3% by vol. (obtained from the Udylite Company) | |
| Chloride ($Cl^-$ = 20 mg/l) | |
| Room temp. | |
| Air agitation | |
| Current density 30 ASF | |
| Plating rate 0.6 mils 20 min. | |

-continued

| | |
|---|---|
| 2. Watts Nickel (M&T 323 Process) | |
| Nickel sulfate ($NiSO_4 . 6H_2O$) | 300 g/l |
| Nickel chloride ($Ni . Cl_2 . 6H_2O$) | 45 g/l |
| Boric Acid B(OH)3 | 45 g/l |
| $B_4$ (obtained from M&T Chemical Co., Rahway, N.J.) | 2 cc/l |
| $A_5$ (obtained from M&T Chemical Co.) | 40 cc/l |
| SA (obtained from M&T Chemical Co.) | 35 cc/l |
| X17 (obtained from M&T Chemical Co.) | 4 cc/l |
| 3. Micro cracked chrome | |
| Chromic Acid ($CrO_3$) | 245 g/l |
| Fluosilicic Acid ($H_2SiF_6$) | 49 g/l |
| Sulfuric Acid ($H_2SO_4$) | 1.2 g/l |
| Anodes | 10/90 Sn/Pb |
| Temperature | 115° F |
| Agitation | Mechanical Stirring |
| Current Density | 200 ASF |
| Plating rate | .1 mils 10 min. |
| 4. Nickel fluoborate | |
| Basic bath | |
| Nickel fluoborate (Ni equiv. 110 g/l) | 440 g/l |
| pH | 3.0–4.5 |
| Temperature | 110° F |
| Agitation | air |
| Current density | 75 ASF |
| Time for 0.8 mils at 75 ASF 10 minutes | |
| 5. As 4 but containing | |
| Saccharin | 1.0 g/l |
| 6. As 4 but containing brightening system | |
| Additive Br (1.0 ml/100 ml) (Allied Chemical Corporation see U.S. Pat. No. 3,661,731) | |
| Coumarin | 1.5% b.w. |
| Tamol N | 1.5 |
| Water | 97.0% |
| Additive SR (Allied Chemical 3,661,731) | Variable* |
| Saccharin, sodium salt | 10.0% b.w. |
| Water | 90.0% |
| Additive WA (0.5 ml/100 ml) (Allied Chemical Corporation see U.S. Pat. No. 3,661,731) | |
| Sodium lauryl sulfate | 0.4% b.w. |
| Castile soap | 0.1% b.w. |
| Water | 99.5% b.w. |
| 7. Tin Bath | |
| Stannous Fluoborate ($Sn(Bl_4)_2$) | 200 g/l |
| Stannous Tin (Sn++) | 81 g/l |
| Fluoboric acid H | 100 |
| B Naphthol | 1 g/l |
| Gelatin or | 6 g/l |
| Peptone | 5 g/l |
| Agitation | Mild mechanical |
| Temp. | room |
| Current Density | 20 ASF (amperes/ square foot) |
| Plating rate | 0.6 mils 15 min. |
| 8. 90 Sn/10 Pb Bath | |
| Stannous fluoborate | 44.5 g/l |
| $Sn^{++}$ | 18 g/l |
| Lead Fluoborate | 3.7 g/l |
| $Lead^{++}$ | 2 g/l |
| Fluoboric acid | 350 g/l |
| Boric acid | 25 g/l |
| Peptone | 5 g/l |
| Anodes | 90 Sn/10 Pb |
| Temperature | Room |
| Agitation | Mechanical |
| Current density | 20 ASF |
| Time | 0.6 mil 13.8 min. |
| 9. 10/90 Tin lead Bath | |
| Tin Fluoborate | 22 g/l |
| Tin Metal $Sn^{++}$ | 9 g/l |
| Lead fluoborate | 168 g/l |
| Lead Pb | 90 g/l |
| Hydroquinone | 5 g/l |
| Fluoboric Acid ($HBF_4$) | 100 g/l |
| Anodes | 10 Sn 90 Pb |
| Agitation | Mechanical |
| Current density | 20 ASF |
| Plating Rate | .6 mils 13.8 min. |
| 10. Lead Bath | |
| Lead Fluoborate | 200 g/l |
| Lead | 108 g/l |
| Fluoboric acid | 50 g/l |
| Hydroquinone | 5 g/l |
| Agitation | Mechanical |
| Current Density | 25 ASF |

-continued

| | |
|---|---|
| Plating Rate | .6 mils 10 min. |

*Vary additive SR level at 1.0 and 1.5 g/l.

EXAMPLES 3–13

Plates, coated as in Example 1, were electroplated with the baths of Example 2 under the conditions of Examples 2 for each bath except that the time was varied to produce the desired thickness. Examples 3–8 represent the prior art copper-nickel-chromium systems. Twenty plates were prepared according to system A of Table 1; ten plates were prepared according to each of systems B–K of Table 1.

TABLE 1

| | Thickness (mils) Layer | | |
|---|---|---|---|
| Plating System | 1 | Ni | Cr |
| Example 3 | | | |
| UBAC Copper | 0.6 | | |
| Watts nickel M&T 323 | | 0.8 | |
| Chromium | | | 0.1 |
| Example 4 | | | |
| UBAC copper | 0.6 | | |
| Ni $(BF_4)_2$-as is | | 0.8 | |
| Chromium | | | 0.1 |
| Example 5 | | | |
| UBAC copper | 0.6 | | |
| Low stress $Ni(BF_4)_2$ | | 0.8 | |
| Chromium | | | 0.1 |
| (Stress reducer only) | | | |
| Example 6 | | | |
| UBAC copper | 0.6 | | |
| $Ni(Bf_4)_2$-bright 1.0 g/l sacch. | | 0.8 | |
| Chromium | | | 0.1 |
| Example 7 | | | |
| UBAC copper | 0.6 | | |
| $Ni(BF_4)_2$-bright 1.5 g/l sacch. | | 0.8 | |
| Chromium | | | 0.1 |
| Example 8 | | | |
| Tin Fluoborate | 0.6 | | |
| Nickel Fluoborate | | 0.07 | |
| Watts Nickel | | 0.8 | |
| Chromium | | | 0.1 |
| Example 9 | | | |
| 90 Sn 10 Pb | 0.6 | | |
| Nickel Fluoborate | | 0.17 | |
| Watts nickel | | 0.8 | |
| Chromium | | | 0.1 |
| Example 10 | | | |
| 10 Sn/90 Pb | 0.6 | | |
| Nickel Fluoborate | | 0.7 | |
| Watts Nickel | | 0.08 | |
| Chromium | | | 0.1 |
| Example 11 | | | |
| Lead Fluoborate | 0.6 | | |
| Nickel Fluoborate | | 0.07 | |
| Watts Nickel | | 0.8 | |
| Chromium | | | 0.1 |
| Example 12 | | | |
| 10 Sn/90 Pb | 0.6 | | |
| Nickel Fluoborate | | 0.8 | |
| Chromium | | | 0.1 |
| Example 13 | | | |
| Lead Fluoborate | 0.6 | | |
| Nickel Fluoborate | | 0.8 | |
| Chromium | | | 0.1 |

One half of each group of plaques prepared according to Examples 3–13 were tested by thermal cycling twice a day through the following cycle: one hour at 185° F, one hour normalized to room temperature, one hour at −20° F, normalized again to room temperature. After each cycle, the plaques were examined. The plaques were run through 5 cycles or until all plaques failed. The high and low temperatures were achieved by placing in an oven and a freezer, respectively.

Failure was observed as blistering, cracking, peeling or other defects not observed prior to thermal cycling, with observations made without magnification. Defects observed were confirmed at 3X magnification.

The results are summarized in the Thermal Cycling column of Table 2.

TABLE 2

| PLATING (from Table 1) | THERMAL CYCLE | CASS (Corrosion Test) |
|---|---|---|
| | Example 14 | Example 15 |
| Example 3 | | |
| | 6 samples good<br>4 samples blisters | 1 sample good<br>9 samples blisters<br>copper showing |
| Example 4 | | |
| | 4 samples good<br>1 sample 1 blister | all blistered<br>no copper showing |
| Example 5 | | |
| | all samples good | 2 samples no blisters<br>3 samples very small<br>blisters no copper |
| Example 6 | | |
| | all samples good | 1 plating break through<br>3 samples no blisters<br>1 slight blister<br>no copper showing |
| Example 7 | all samples good | 2 samples no blisters<br>3 samples blisters |
| Example 8 | all bad | no CASS tests |
| Example 9 | all bad | all bad |
| Example 10 | 4 plates cracks<br>1 plate good | 3 numerous small blisters<br>2 blisters and cracks |
| Example 11 | all plates cracked | 3 numerous small blisters<br>2 blisters and cracks |
| Example 12<br>10/90 tin lead<br>Fluoborate Nickel | 2 good<br>2 few small cracks | numerous small blisters |
| Example 13<br>Pb Fluoborate<br>Nickel | all good | 2 no blisters<br>3 few small blisters<br>1 blister |

EXAMPLE 15

CASS Testing for Corrosion Resistance

The other half of each group of plaques was subjected to accelerated salt spray accord to ASTM B-368-68 known as CASS ("Copper Accelerated Acetic Acid Salt Spray"). The results of this standard test are summarized in the CASS column of Table 2. Exposure periods were for 16 hours up to a total run of 200 hours unless all of the plaques had failed prior to that time. 20 plaques were run simultaneously in a standard CASS cabinet.

The results of Examples 14 and 15 show that lead or tin-nickel-chromium plated plaques performed as well as copper-nickel-chromium plated plaques without unsightly green copper corrosion products. In particular, the lead-nickel-chromium plated plaques of Example 13 performed better overall than any of the copper-nickel-chromium plated plaques. Use of the more expensive tin is avoided.

EXAMPLES 16–25

Plaques are prepared using electroless and electrolytic baths as shown in Table 3. Essentially the same results are noted, with low corrosion and cracking.

TABLE 3

| Example | Electroless Coating | Electrolytic Plating | |
|---|---|---|---|
| 16 | Nickel | Lead (Fluoborate) | 0.05 mils |
| | | Nickel (Fluoborate) | 2.0 mils |
| | | Chromium | 0.5 mils |
| 17 | Copper | Copper Strike | |
| | | Tin (Sodium Stannate) | 0.10 mils |
| | | Nickel (Fluoborate) | 1.0 mils |
| | | Chromium | 0.2 mils |
| 18 | Nickel | Nickel Strike | |
| | | 50% Lead, 50% Tin (Fluoborate) | 1.0 mils |
| | | 50% Nickel, 50% Cobalt | 0.5 mils |
| 19 | Copper | 90% Lead, 10% Copper (Fluoborate) | 0.5 mils |
| | | Cobalt (Sulfamate) | 2.0 mils |
| | | Chromium | 0.05 mils |
| 20 | Silver | Lead 90%, Antimony 10% (Fluoborate) | 1.0 mils |
| | | Nickel 10%, Cobalt 90% (Fluoborate) | 1.5 mils |
| | | Chromium | 0.01 mil |
| 21 | Nickel | Lead 95%, Antimony 0.5% Copper 4.5% (Fluoborates) | 1.0 mil |
| | | Nickel (Chloride) | 1.5 mil |
| 22 | Nickel | Nickel Strike | |
| | | Tin 95%, Copper 5% (Sulfates) | 1.0 mil |
| | | 80% Cobalt 20% Tin (Fluoborate) | 1.0 mil |
| | | Chromium | 0.02 mil |
| 23 | Nickel | Nickel Strike | |
| | | Tin 40%, Lead 40%, Copper 20% (Fluoborate) | 1.0 mil |
| | | Cobalt 80%, Lead 20% (Sodium Stannate) | 0.6 mil |
| | | Chromium | 0.08 mil |
| 24 | Copper | Nickel Strike | |
| | | Lead (Fluoborate) | 0.5 mil |
| | | Nickel (Chloride) | 1.1 mil |
| | | Chromium | 0.2 mil |
| 25 | Nickel | Nickel Strike | |
| | | Lead (Fluosilicate) | 0.8 mil |
| | | Nickel (Fluoborate) | 0.8 mil |
| | | Chromium (microcracked) | 0.2 mil |

We claim:

1. A method of forming an electroplated article from a substrate, said substrate being a non-conductive plastic, comprising the steps:

(a) depositing a thin film of conductive metal on said non-conductive plastic to form a metal surface;

(b) electrolytically plating on said metal surface a metal sublayer having predominantly a metal selected from the group consisting of lead, tin and mixtures thereof on said surface from an electrolytic bath containing lead cations, tin cations or both;

(c) electrolytically plating a second layer having predominantly a metal selected from the group consisting of nickel, cobalt and mixtures thereof directly onto said metal sublayer from an electrolytic bath containing nickel fluoborate, cobalt fluoborate or both; and (d) electrolytically plating chromium onto said second layer.

2. A method as claimed in claim 1 wherein said metal sublayer is plated from an electrolytic bath wherein said lead cations form at least about 50% of the effective cations.

3. A method as claimed in claim 2 wherein said lead cations include at least about 75% of the effective cations.

4. A method as claimed in claim 1 wherein said metal sublayer is plated from an electrolytic tin bath wherein said tin cations include at least about 50% of the effective cations.

5. A method as claimed in claim 4 wherein said metal sublayer is plated from an electrolytic tin bath wherein said tin cation include at least about 75% by weight of effective cation.

6. A method as claimed in claim 1 wherein said metal sublayer is plated from an electrolytic bath wherein said lead cations and tin cations together include at least about 75% of the effective cations.

7. A method as claimed in claim 1 wherein said electrolytic bath further includes other cations selected from the group consisting of antimony, copper and mixtures thereof, with said other cations including from about 0.005 to about 10% of the effective cations.

8. A method as claimed in claim 1 wherein said metal sublayer is deposited from an electrolytic bath including lead fluoborate, tin fluoborate or mixtures thereof.

9. A method as claimed in claim 8 wherein said electrolytic bath includes lead fluoborate and hydroquinone.

10. A method as claimed in claim 1 wherein said second bath includes nickel fluoborate.

11. A method as claimed in claim 1 wherein said second bath includes nickel cations, cobalt cations or both, and said nickel and cobalt cations include at least about 75% of the effective cations.

12. A method as claimed in claim 1 wherein said chromium is deposited from a bath including chromium oxide and a microcracking agent.

13. A method as claimed in claim 12 wherein said microcracking agent is fluosilicic acid.

* * * * *